US005449857A

United States Patent [19]

Ohshima

[11] Patent Number: 5,449,857

[45] Date of Patent: Sep. 12, 1995

[54] ELECTRONIC MUSICAL INSTRUMENT CAPABLE OF FREE EDIT AND TRIAL OF DATA HIERARCHY

[75] Inventor: Osamu Ohshima, Hamamatsu, Japan

[73] Assignee: Yamaha Corporation, Japan

[21] Appl. No.: 220,964

[22] Filed: Mar. 31, 1994

[30] Foreign Application Priority Data

Apr. 6, 1993 [JP] Japan ..... 5-079885

[51] Int. Cl.[6] ..... G10H 1/22

[52] U.S. Cl. ..... 84/618; 84/DIG. 2

[58] Field of Search ..... 84/615–620, 84/DIG. 2

[56] References Cited

U.S. PATENT DOCUMENTS 5,298,675 3/1994 Nishimoto et al. ..... 84/DIG. 2

*Primary Examiner*—Stanley J. Witkowski

*Attorney, Agent, or Firm*—Graham & James

[57] ABSTRACT

An electronic musical instrument is constructed to carry out an edit work of control parameters and a trial play for evaluation of the edit work. The control parameters are registered in a hierarchical format to define a plurality of hierarchical classes. A first hierarchical class is designated as an object of the edit work. A control parameter belonging to the first hierarchical class is changed to carry out the edit work. A second hierarchical class is designated as an object of the trial play independently from the first hierarchical class. In response to a trial command, a tone generator generates a musical tone based on a control parameter belonging to the second hierarchical class to thereby carry out the trial play. Further, a third hierarchical class preceding the second hierarchical class can be designated such that a control parameter belonging to the third hierarchical class is inherited to the second hierarchical class for use in the trial play.

10 Claims, 14 Drawing Sheets

ELECTRONIC MUSICAL INSTRUMENT CAPABLE OF FREE EDIT AND TRIAL OF DATA HIERARCHY

BACKGROUND OF THE INVENTION

The present invention relates to an electronic musical instrument constructed such as to carry out a trial play based on timbre data belonging to a desired hierarchical level or class after an edit work of a timbre data hierarchy.

There is known a conventional electronic musical instrument of the type registering musical tone control parameters such as timbre parameters which can be edited. The conventional instrument can commence a trial play in response to a trial command during the course of the edit work of the registered control parameters to evaluate edited results. Further, a recent type of the electronic musical instrument registers the control parameters in a data hierarchy composed of hierarchical levels or classes such that the edit work can be conducted by class by class basis. However, in the electronic musical instrument having the data hierarchy of the musical tone control parameters, the trial play is carried out in response to a trial command during the course of the edit work, such that musical tones are generated based on control parameters belonging to limited classes not higher than an object class of the edit work. Consequently, it is difficult to readily evaluate how the edit results of an individual parameter affect the entire hierarchical structure in the trial play. Further, preceding parameters ranked higher than the edited class are not reflected in the trial play, hence trial plays must be carried out repeatedly with respect to various levels in order to obtain desired musical tones, thereby hindering efficient synthesis of musical tones.

SUMMARY OF THE INVENTION

In view of the above noted drawbacks of the prior art, an object of the present invention is to provide an electronic musical instrument capable of readily and efficiently evaluating edit works of the musical data hierarchy.

In one aspect of the invention, an electronic musical instrument is constructed to carry out an edit work of control parameters and a trial play to evaluate the edit work in response to a trial command. The instrument comprises memory means for memorizing the control parameters in a hierarchical structure to define a plurality of hierarchical classes of the control parameters, first designating means for designating a first hierarchical class as an object of the edit work, edit means for changing a control parameter belonging to the first hierarchical class to carry out the edit work, second designating means operable independently from the first designating means for designating a second hierarchical class as an object of the trial play freely from the edit work, and tone generator means responsive to a trial command for generating a musical tone based on a control parameter belonging to the second hierarchical class to thereby carry out the trial play.

In another aspect of the invention, the electronic musical instrument comprises memory means for memorizing control parameters in a hierarchical structure to define a plurality of hierarchical classes of the control parameters, edit means for selectively changing a desired control parameter to carry out the edit work in the hierarchical structure, a designating means for designating one hierarchical class as an object of the trial play after the edit work, tone generator means responsive to a trial command for generating a musical tone based on a control parameter belonging to said one hierarchical class to carry out the trial play, and another designating means for designating another hierarchical class which precedes said one hierarchical class such that another control parameter belonging to said another hierarchical class is selectively inherited to said one hierarchical class for use in the trial play.

According to the one aspect of the invention, the second hierarchy class for the trial play can be designated freely relative to the first hierarchy class designated for the edit work. For example, the second hierarchical class is designated higher than the first hierarchical class. Otherwise, the second hierarchical class is designated lower than the first hierarchical class.

According to the other aspect of the invention, one hierarchy class for the data inheritance can be designated freely relative to another hierarchical class designated for the trial play. By such an operation, a control parameter belonging to said one hierarchical class can be inherited to said another hierarchical class for use in the trial play to thereby examine hierarchical relationship of control parameters belonging to different hierarchical classes.

DETAILED DESCRIPTION OF THE INVENTION

Figure 1:
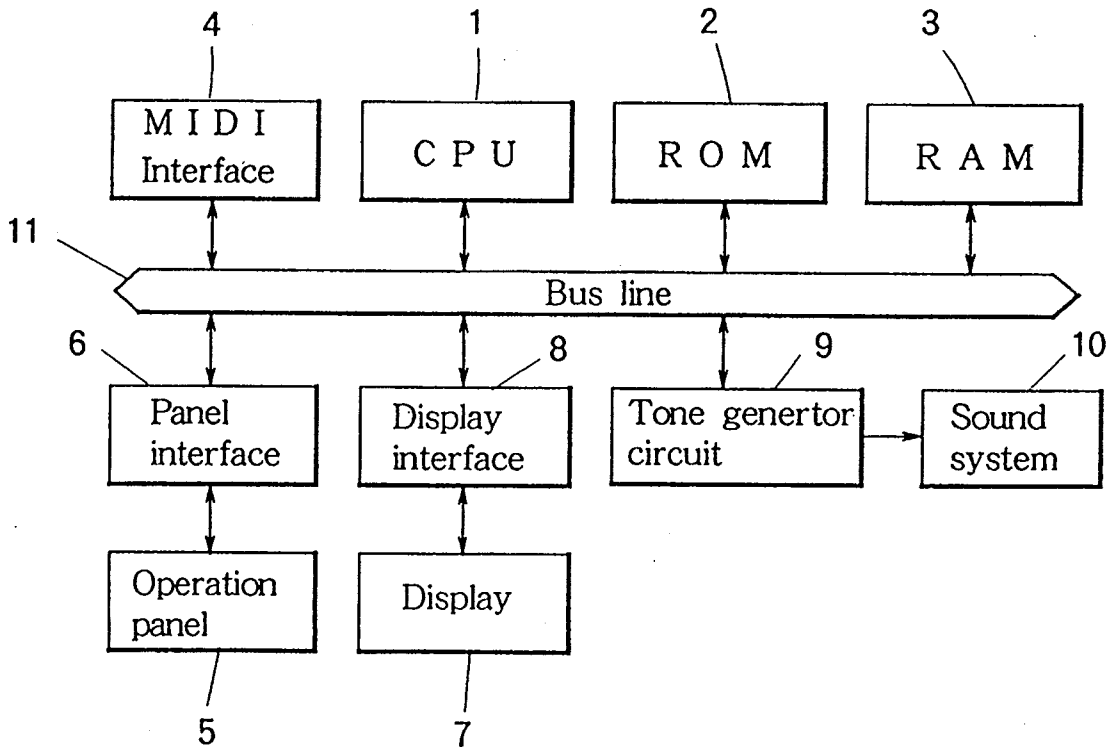
FIG. 1 is a block diagram showing an overall construction of the inventive electronic musical instrument.

Hereinafter, embodiments of the present invention will be described in conjunction with the drawings. FIG. 1 is a block diagram showing an overall construction of one embodiment of the electronic musical instrument according to the invention. The inventive electronic musical instrument has a central processing unit (CPU) 1 for controlling various components connected through a bus line 11. A ROM 2 stores various control programs loaded by the CPU 1. A RAM 3 is utilized to provide a working area of the CPU 1 for memorizing timbre data having a hierarchical structure (timbre data hierarchy) and a data management table for managing the timbre data hierarchy, in addition to various register values and computation results.

Figure 2:
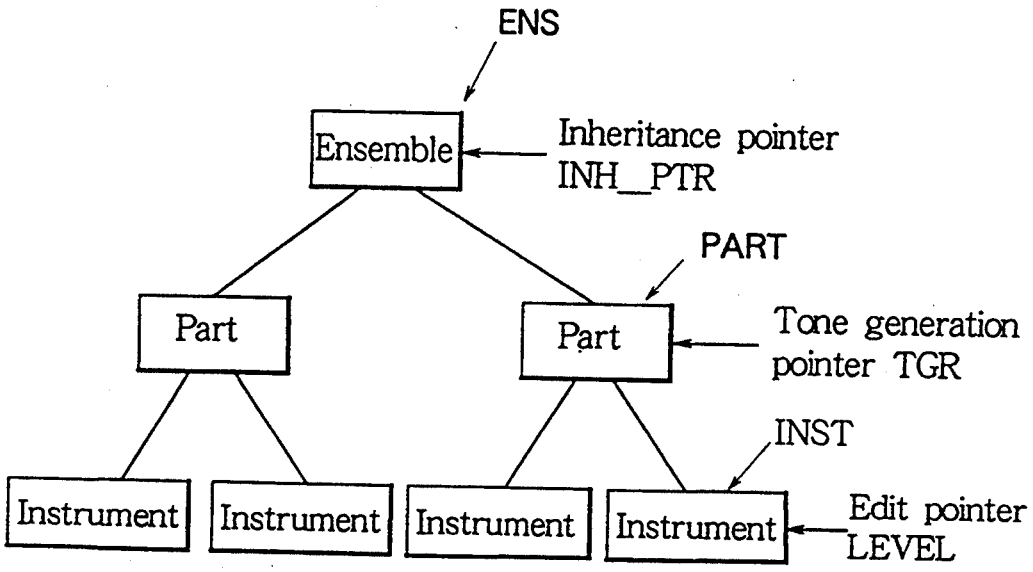
FIG. 2 is a schematic diagram showing a timbre data hierarchy registered in the inventive electronic musical instrument.

Referring to FIG. 2, the timbre data hierarchy memorized in the RAM 3 is composed of a lower "instrument class" (INST), a middle "part class" (PART) and a higher "ensemble class" (ENS). A desired class is designated by "pointers" according to a command by a player of the musical instrument. The pointers include an "edit pointer" (LEVEL) effective to designate a certain class as an object of an edit work, a "tone generation pointer" (TGR) effective to designate a certain class as an object of a trial play in case of evaluating a result of the edit work and else, and an "inheritance pointer" (INH_PTR) effective to designate one class from which a musical tone control parameter is inherited to another class designated for the tone generation. Detailed description will be given later for the respective pointers.

Figure 3:
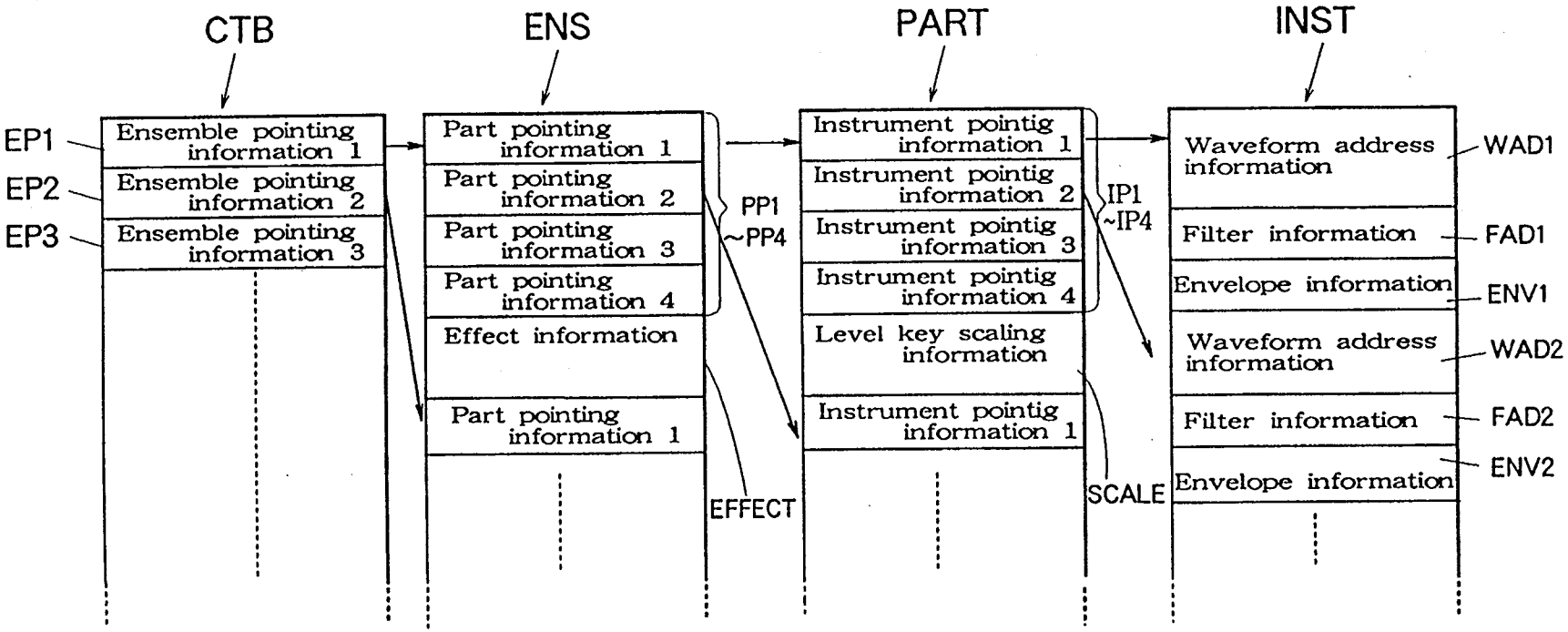
FIG. 3 is a schematic diagram showing a detailed data format of the timbre data hierarchy.

FIG. 3 shows a detailed data structure of each class of the timbre data hierarchy, which is registered in the electronic musical instrument having a tone generator of the waveform memory addressing type. The lower instrument class INST includes a plurality of instrument members such as piano, violin, guitar and so on. For instance, the first instrument member contains a set of waveform address information WAD1, filter information FAD1 and envelope information ENV1. The waveform address information. WAD1 represents start addresses and end addresses effective to control retrieval of an attack section, a loop section and a release section of a musical tone waveform memorized in a waveform memory. The filter information FAD1 determines a cutoff frequency of a filter contained in the tone generator. The envelope information ENV1 determines an attack rate and a release rate of the musical tone waveform. Thus, those of the waveform address information, filter information and envelope information characterize a timbre of a specific musical instrument. In similar manner, the second instrument member contains another set of the waveform address information WAD2, filter information FAD2 and envelope information ENV1.

The middle part class PART includes a plurality of part members. Each part member is composed of several instrument submembers, e.g., four instrument members in this embodiment. Each part member contains instrument pointing information IP1, IP2, IP3 and IP4 corresponding to the four constituent instrument members, and level key scaling information SCALE. The instrument pointing information IP1–IP4 indicates a top data address of the four respective instrument members which are selected to compose one part member. The level key scaling information SCALE determines a key scaling of a keyboard equipped in the electronic musical instrument.

The higher ensemble class ENS includes a plurality of ensemble members. Each ensemble member is composed of several part submembers, e.g., four part members in this embodiment. Each ensemble member contains part pointing information PP1, PP2, PP3 and PP4 corresponding to the four constituent part members, and effect information EFFECT. The part pointing information PP1–PP4 indicates a top data address of the four respective part submembers which are selected to compose one ensemble item. The effect information EFFECT contains parameters effective to specify and to control a particular effect applied to the musical tones involved in one ensemble item. Further, a data management table CTB contains ensemble pointing information EP1, EP2, EP3 . . . , which indicates a top data address of corresponding ensemble items.

Referring back to FIG. 1, the description is given for the remaining components of the instrument. A MIDI interface 4 is provided to connect to an external Musical Instrument Digital Interface (MIDI) equipment such as a keyboard (not shown in the figure) for use in trial play and actual play. The MIDI interface 4 feeds a key touch signal to the CPU 1 in response to key depression and key release operation of the connected keyboard. An operation panel 5 contains various operation pieces manipulated, for example, to set those of the edit pointer LEVEL, tone generation pointer TGR and inheritance pointer INH_PTR to desired classes (FIG. 2). A panel interface 6 detects manipulation of the operation pieces on the panel 5 to feed corresponding signals to the CPU 1.

Figure 4:
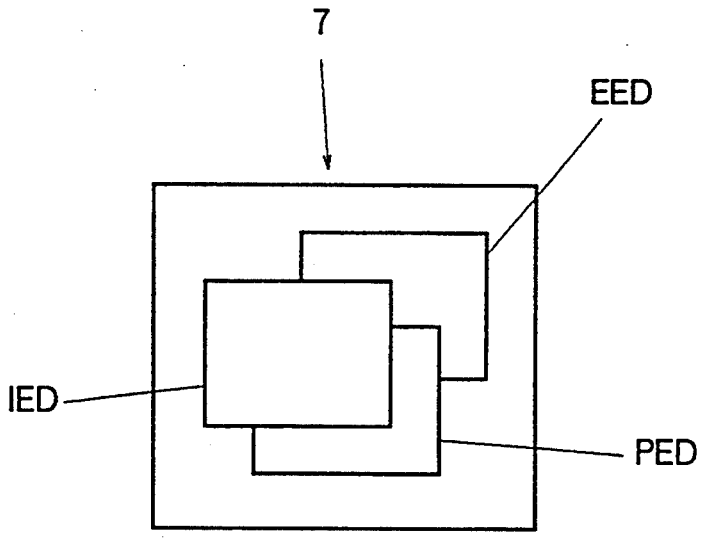
FIG. 4 is a schematic diagram showing a display provided in the inventive electronic musical instrument.

A display 7 can provide a multiple of windows in its field. Referring to FIG. 4, the display 7 is controlled to select one of edit windows IED, PED and EED which correspond to the instrument class, part class and ensemble class, respectively. Each edit window is opened for the edit work. Namely, a desired edit window is selected by means of a mouse implement or else to carry out the edit work for the desired class of the timbre data hierarchy.

Figure 5:
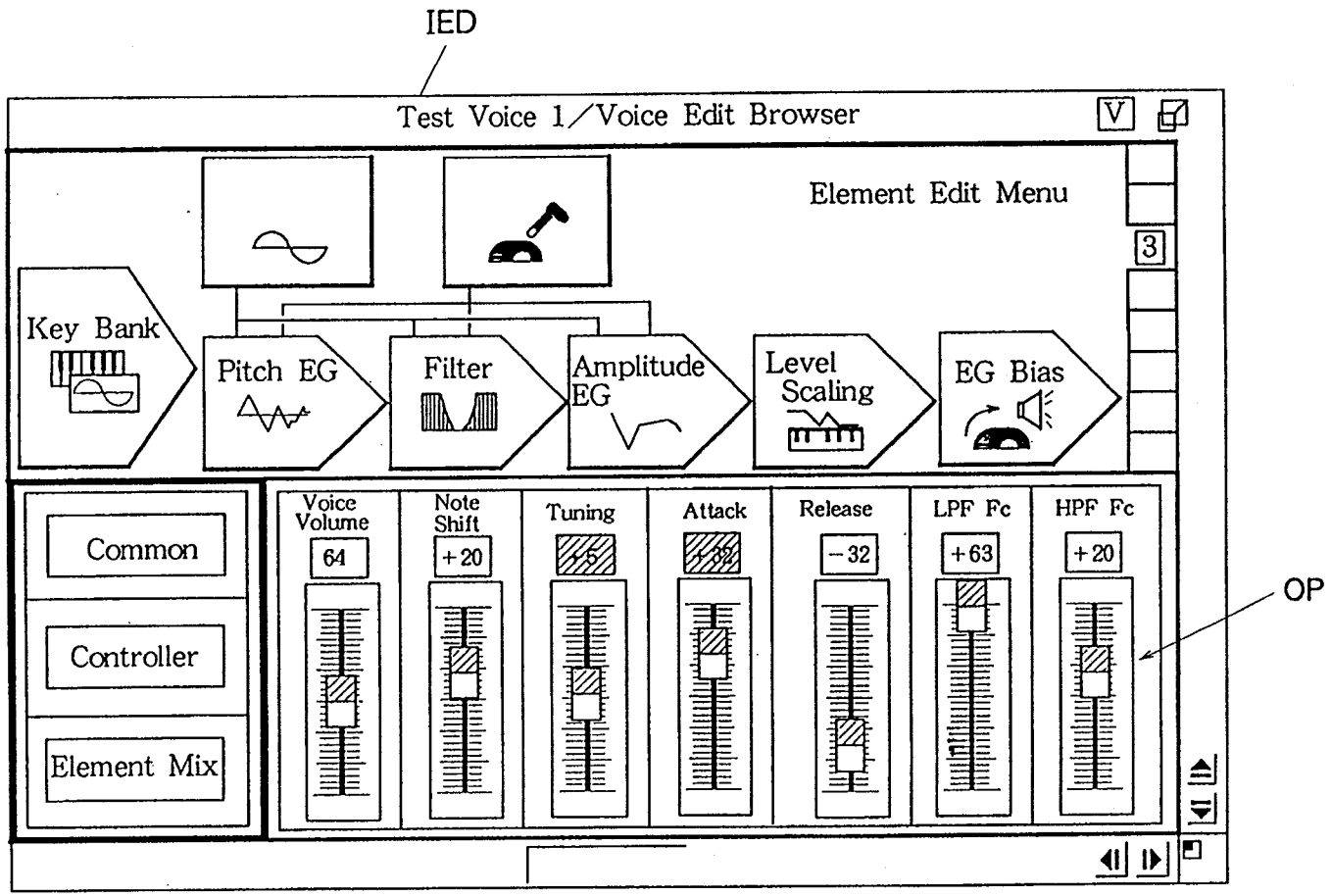
FIG. 5 is an illustrative diagram showing an example of edit windows opened in the display.

Referring further to FIG. 5, one example of the edit window corresponding to the instrument class INST is opened on the display 7 to show one instrument member to be edited. In the edit work, the mouse implement is manipulated to access a displayed virtual operation piece OP to set a desired value to a selected parameter such as a filter cutoff frequency or else.

Referring back again to FIG. 1, a display interface 8 converts display information fed from the CPU 1 into a given data format which is admitted by the display 7. A tone generator circuit 9 is of the waveform memory addressing type for generating a musical tone signal according to musical tone control parameters extracted from the timbre data hierarchy by means of the CPU 1. A sound system 10 applies a filtering treatment and else to the musical tone signal fed from the tone generator circuit 9 in order to remove a noise, and thereafter amplifies the musical tone signal to emit a musical sound through a loudspeaker (not shown in the figure).

Next, the description is given for the operation of the inventive electronic musical instrument in conjunction with flowcharts shown in FIGS. 6–14.

Basic operation

Figure 6:
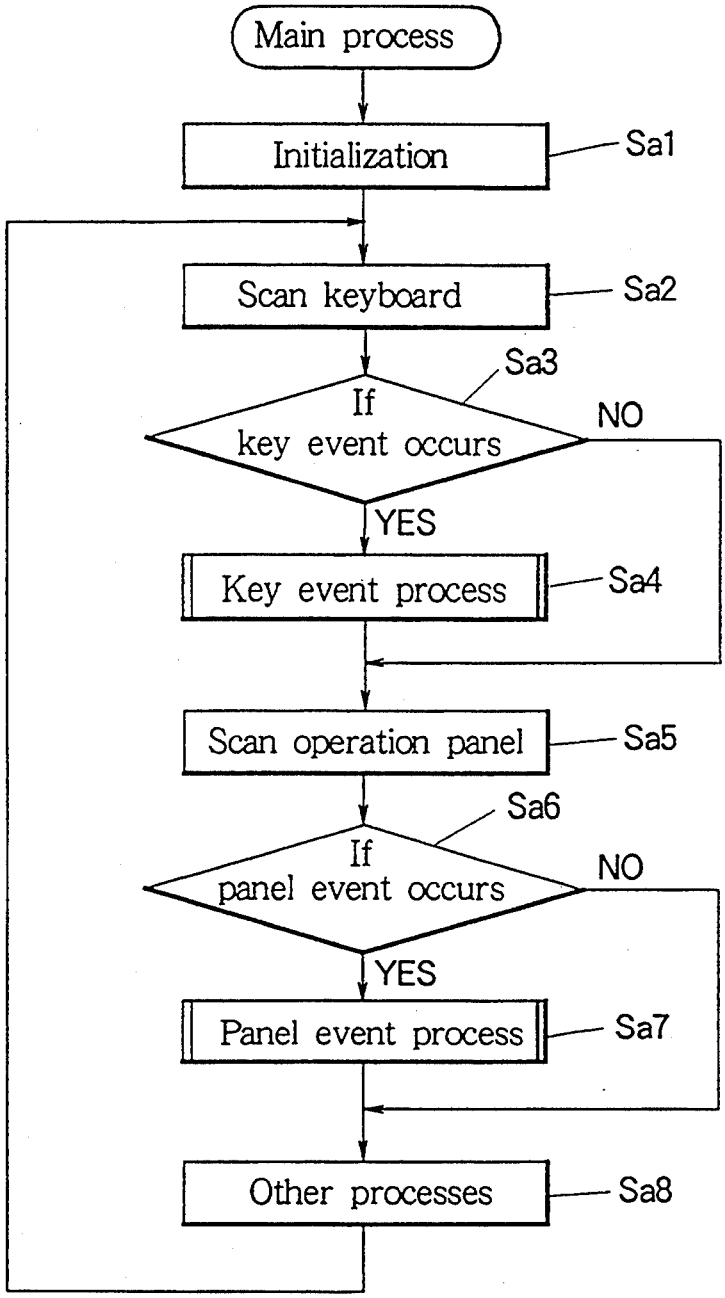
FIG. 6 is a flowchart showing a main routine executed in the inventive electronic musical instrument.

Initially, the instrument apparatus is turned on so that the CPU 1 loads the control program from the ROM 2 into the RAM 3 to commence a main process routine shown in FIG. 6. By this, the CPU 1 starts first Step Sa1 to carry out initialization such as resetting of various registers. Then, Step Sa2 is undertaken to scan the keyboard through the MIDI interface 4 so as to detect a key touch on the keyboard (hereinafter, referred to as "key event"). In following Step Sa3, check is made as to if a key event occurs. If the check result shows YES, Step Sa4 is undertaken to call a key event process routine (which will be described later in detail) to thereby execute a key event process. Then, Step Sa5 is undertaken. On the other hand, if the check result of Step Sa3 is held NO, the main routine jumps to Step Sa5 without carrying out Step Sa4.

In Step Sa5, the operation panel 5 is scanned by the CPU 1 through the panel interface 6 to detect any manipulation of the operation pieces on the panel (hereinafter, referred to as "panel event"). Then, Step Sa6 is undertaken to check as to if a panel event occurs. If this check result shows YES, subsequent Step Sa7, is undertaken to call a panel event process routine (which will be described later in detail) to conduct a panel event process. Then, the main routine proceeds to Step Sa8. On the other hand, if the check result of Step Sa6 is held NO, the main routine jumps to Step Sa8 without executing Step Sa7. In final Step Sa8, other processes such as a display process are carried out, thereby returning to Step Sa2. By such a manner, the main routine of Steps Sa2–Sa8 is repeatedly carried out.

Key event process

Next, the detailed description is given for the key event process. As described above, when the key event is detected, Step Sa4 of the main routine commences the key event process routine shown in FIG. 7. Initially, the CPU 1 proceeds to first Step Sb1 of this subroutine. In Step Sb1, check is made as to if the detected key event (KEV) is a key-on event (KON). If this check result is found YES, subsequent Step Sb2 is undertaken to check as to if the tone generation pointer TGR designates the instrument class INST. Then, the routine branches into three routes dependent on that the tone generator TGR designates the instrument class INST, the part class PART or the ensemble class ENS.

First case of TGR designating INST

In this case, the check result of Step Sb2 is found YES (TGR="INST") to thereby proceed to Step Sb3. In this step, check is made as to if the inheritance pointer INH_PTR designates the ensemble class ENS which precedes the instrument class INST. If this check result is found YES (INH_PTR="ENS"), subsequent Step Sb4 is undertaken to read out a particular effect parameter EFFECT from an address of a given ensemble member pointed by an ensemble address pointer ENS_PTR so that, the read effect parameter EFFECT is set to an effector of the tone generator circuit. By such an operation, the parameter EFFECT belonging to the preceding class ENS is inherited to the succeeding class INST in the tone generating process of a selected instrument member belonging to the lower class INST. Stated otherwise, the tone of the selected instrument member is generated in the trial play while being applied with the effect specified by the inherited parameter EFFECT. Then, Step Sb5 is undertaken to read out a level key scaling parameter SCALE from an address pointed by a part address pointer PART_PTR so that the read parameter SCALE is utilized to set the key scaling. By such a manner, the parameter SCALE belonging to the intervening part class between the higher ensemble class and the lower instrument class is also inherited to the succeeding class INST in the tone generation process of the selected instrument member. Then, this route proceeds to Step Sb9.

On the other hand, the check result of Step Sb3 is found NO if the inheritance pointer INH_PTR does not designate the ensemble class ENS, thereby proceeding to Step Sb6. In this step, the effector is bypassed so that any effect is not applied to the generated tone. Stated otherwise, the parameter EFFECT belonging to the preceding ensemble class ENS is not inherited in the tone generation of the selected instrument member. Then, subsequent Step Sb7 is undertaken to check as to if the inheritance pointer INH_PTR designates the part class PART. If this check result is found YES (INH_PTR="PART"), the routine proceed to the aforementioned Step Sb5 where the parameter SCALE is utilized to set the key scaling. Namely in this case, the parameter SCALE belonging to the preceding part class PART is alone inherited to the succeeding instrument class INST. Then, the routine proceeds to Step Sb9.

On the other hand, the check result of Step Sb7 is found NO if the inheritance pointer INH_PTR does not designate the part class PART, but designates the instrument class INST. In such a case, the routine proceeds; to Step Sb8 where the level key scaling parameter SCALE is set to a default value so that the key scaling is not effected. Namely in this case, either of the parameter EFFECT belonging to the ensemble class ENS and the parameter SCALE belonging to the part class PART is not inherited. Then, the routine proceeds to Step Sb9.

Figure 8:
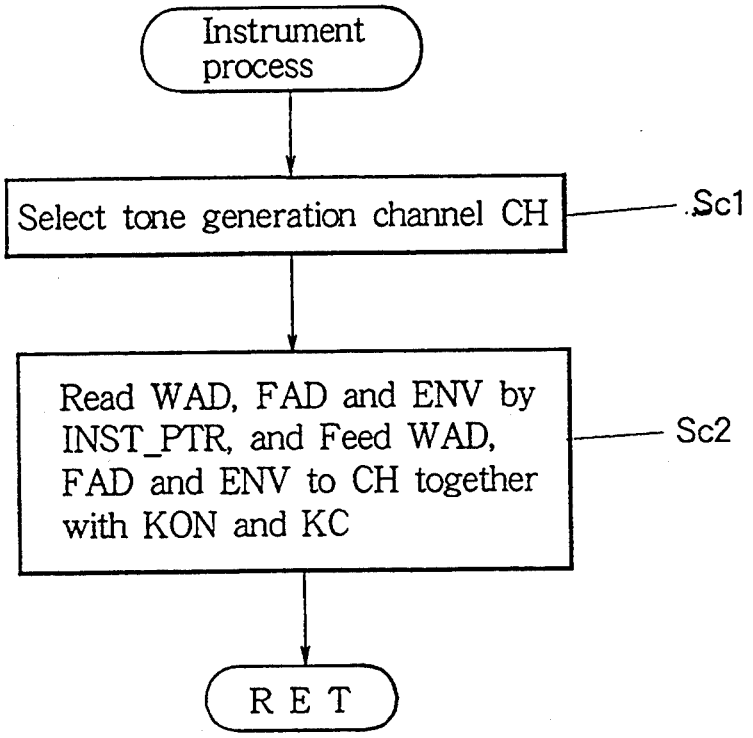
FIG. 8 is a flowchart showing an instrument process routine.

In Step Sb9, an instrument process routine is executed as shown in the flowchart of FIG. 8. The CPU 1 commences first Step Sc1 of this subroutine. In this step, a particular tone generation channel CH is selected in the tone generator circuit 9. Then, Step Sc2 is undertaken to sequentially read out a set of the waveform address information WAD, the filter information FAD and the envelope information ENV from addresses pointed by an instrument address pointer INST_PTR. Further, the retrieved set of WAD, FAD and ENV which define a selected instrument member (FIG. 3) is fed to the reserved tone generation channel CH together with the key-on data KON and the key code KC inputted by the keyboard. Consequently, the tone generation circuit 9 generates a musical tone signal of the selected instrument member. After the instrument process is finished, this routine returns to the main routine (FIG. 6) through the key event process routine.

Second case of TGR designating PART

Figure 7:
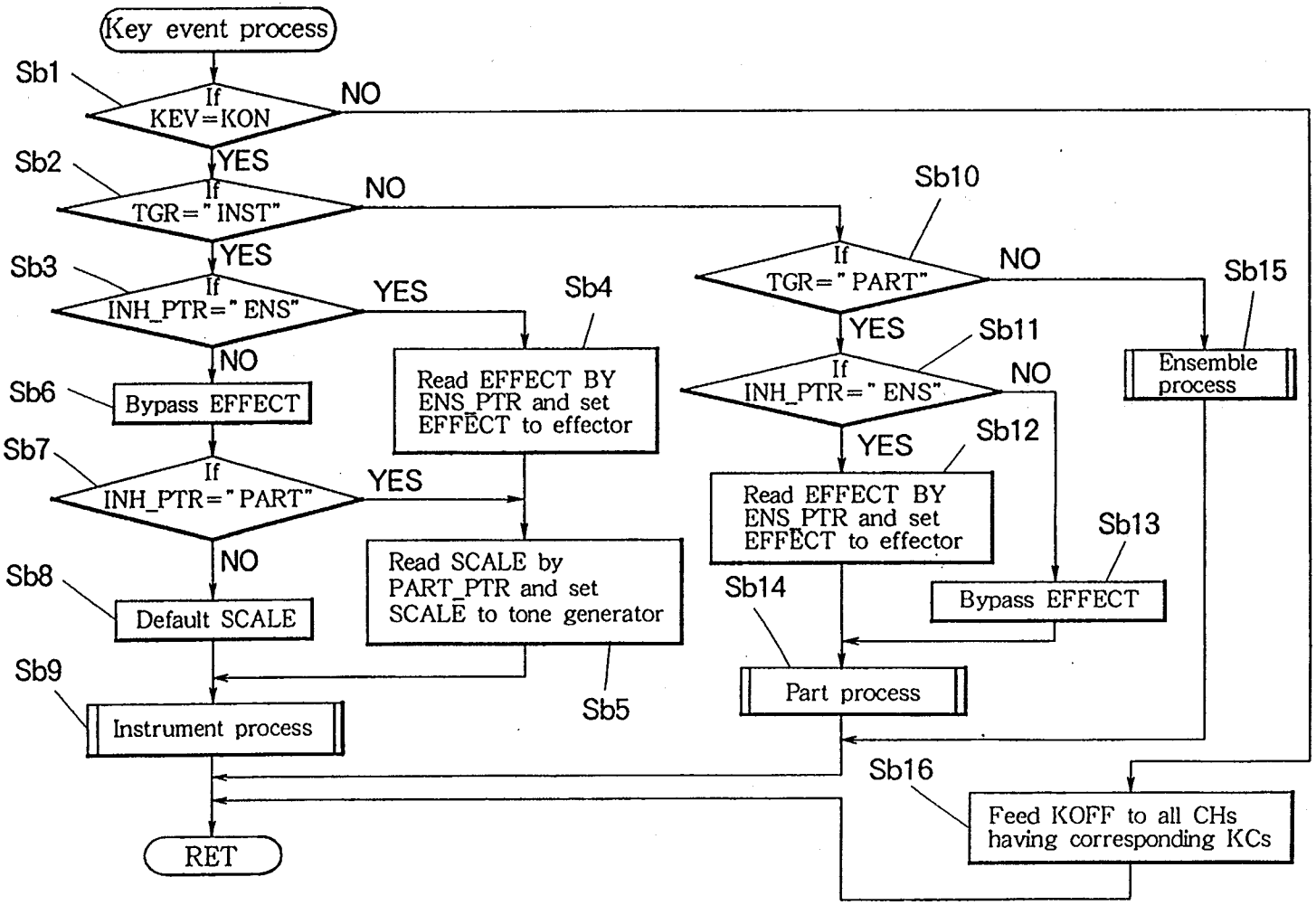
FIG. 7 is a flowchart showing a key event process routine.

Referring back to the flowchart of FIG. 7, the check result of Step Sb2 is found NO when the tone generation pointer TGR does not designate the instrument class, but designates the part class PART. Accordingly, Step Sb10 is undertaken to check as to if the tone generation pointer TGR designates the part class PART. This check result is found YES in this second case, thereby proceeding to Step Sb11. In this step, check is made as to if the inheritance pointer INH_PTR designates the ensemble class ENS. The check result of Step Sb11 is found YES when the inheritance pointer INH_PTR designates the ensemble class ENS, thereby proceeding to Step Sb12. In this step, an effect parameter EFFECT is read out from an address pointed by the ensemble address pointer ENS_PTR such that the retrieved parameter EFFECT is set to the effector. By such a manner, the parameter EFFECT is inherited from the ensemble class to the part class in the tone generation process thereof. Then, next Step Sb14 is undertaken.

On the other hand, the check result of Step Sb11 is held NO when the inheritance pointer INH_PTR does not designate the ensemble class, thereby proceeding to Step Sb13. In this step, the effector is bypassed so that any effect is not applied to the musical tone. Namely, the parameter EFFECT is not inherited in the tone generation process. Then, the routine proceeds to Step Sb14.

Figure 9:
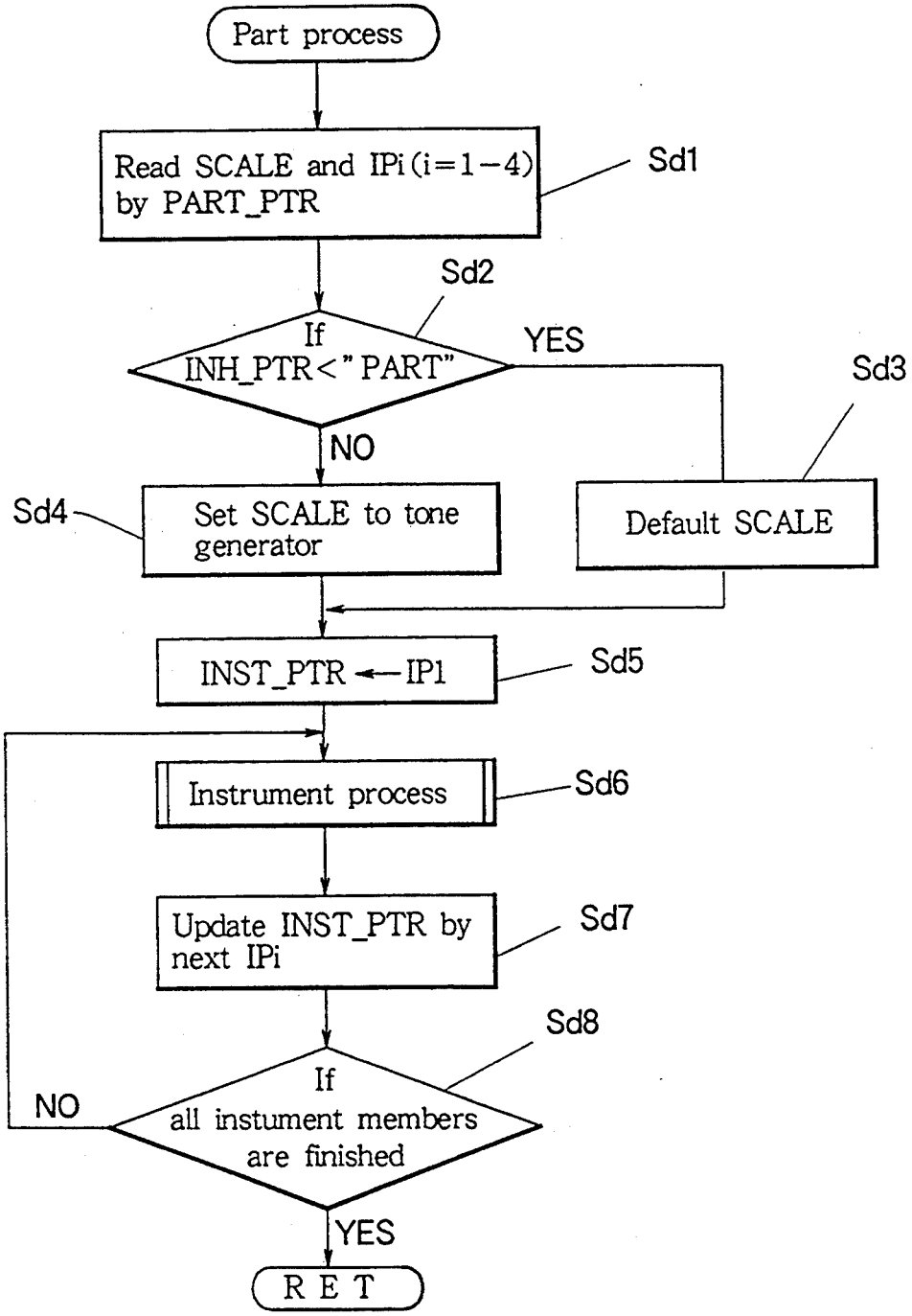
FIG. 9 is a flowchart showing a part process routine.

In this step, a part process routine is commenced as shown in FIG. 9. First, the CPU 1 executes Step Sd1 of the part process routine. In this step, the level key scaling parameter SCALE and the instrument pointing information IPi (i=1–4) are read out from addresses of a selected part member, specified by the part address pointer PART_PTR. Then, check is made in Step Sd2 as to if the inheritance pointer INH_PTR designates a lower class than the part class PART, i.e., if INH_PTR designates the instrument class INST. When the check result of Step Sd2 is found YES (i.e. INH_PTR designates INST), Step Sd3 is undertaken so that the retrieved level key scaling parameter SCALE is ignored and instead thereof a given default value is set to thereby escape the key scaling. By such a manner, the scaling parameter SCALE is not passed from the preceding part class to the succeeding instrument class in the tone generating process.

On the other hand, the check result of Step Sd2 is found NO when the inheritance pointer INH_PTR designates either of the part class PART and the ensemble class ENS. In such a case, subsequent Step Sd4 is undertaken such that the level key scaling parameter SCALE retrieved by Step Sd1 is utilized to set the key scaling. Namely, the parameter SCALE is inherited in the tone generation process. In this embodiment, if the inheritance pointer INH_PTR designates the ensemble class ENS, the parameter SCALE belonging to the intervening part class PART is automatically inherited to the lower instrument class INST. Further, the parameter EFFECT belonging to the ensemble class ENS is also inherited to the instrument class INST.

Next, Step Sd5 is undertaken to set the first instrument pointing information IP1 contained in a selected part member, to the instrument address pointer INST_PTR. Then, Step Sd6 is undertaken to call the instrument process routine (FIG. 8) to thereby execute the instrument process. Further, Step Sd7 is undertaken to update the instrument address pointer INST_PTR according to the second instrument pointing information IP2. Subsequently, check is made in Step Sd8 as to if the instrument process is completed for all of the instrument members involved in the selected part item. If the check result of Step Sd8 is found NO, the routine returns to Step Sd6 to carry out the instrument process for the remaining instrument member specified by the instrument address pointer INST_PTR which has been updated in Step Sd7. Consequently, the instrument process is finished for all of the four instrument members so that the check result of Step Sd8 turns YES. Finally, the CPU 1 ends this part process routine, thereby returning to the main routine (FIG. 6) through the key event process routine (FIG. 7).

Third case of TGR designating ENS

Figure 10:
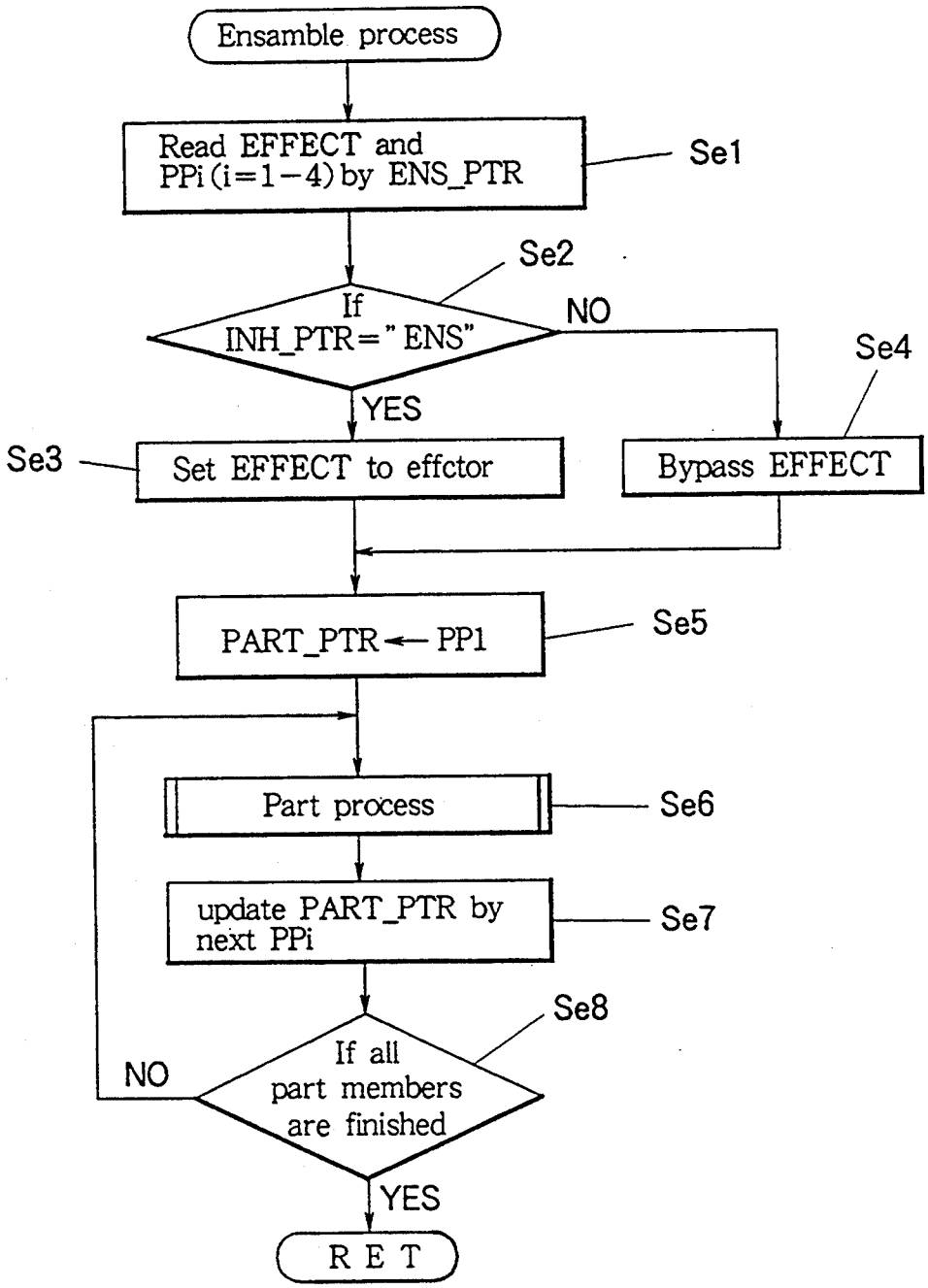
FIG. 10 is a flowchart showing an ensemble process routine.

Referring back again to FIG. 7, since TGR designates ENS, the check results of Sb2 and Sb10 are held NO. Consequently, Step Sb15 is undertaken to commence an ensemble process routine as shown in FIG. 10. The CPU 1 proceeds to first Step Se1 of the FIG. 10 routine. In this first step, the effect parameter EFFECT and the part pointing information PPi (i=1–4) are retrieved from addresses of a selected ensemble item pointed by an ensemble address pointer ENS_PTR. Then, Step Se2 is undertaken to check as to if the inheritance pointer INH_PTR designates the ensemble class ENS. When the check result shows YES (INH_PTR="ENS"), subsequent Step Se3 is undertaken such that the effect parameter EFFECT retrieved by Step Se1 is set to the effector. By such a manner, the parameter EFFECT is utilized in the tone generation of the selected ensemble item.

On the other hand, the check result of Step Se2 is held NO if the inheritance pointer INH_PTR does not designate the ensemble class ENS, thereby proceeding to Step Se4. In this step, the effector is bypassed without using the retrieved parameter EFFECT to suppress application of the effect to the musical tone. Namely, the parameter EFFECT is not reflected in the tone generation. Then, Step Se5 is undertaken such that the first part pointing information PP1 involved in the selected ensemble item is set to the part address pointer PART_PTR. Then, Step Se6 is undertaken to call the part process routine (FIG. 9) to carry out the part process. Further, Step Se7 is undertaken to update the part address pointer PART_PTR according to the second part pointing information PP2. Subsequently, check is made in Step Se8 as to if the part process is completed for all of the part members involved in the selected ensemble item. If the check result of Step Se8 is found NO, this routine returns to Step Se6 to carry out the part process for the remaining part members specified by the part address pointer PART_PTR which has been updated in Step Se7. Consequently, the part process is finished for all the four part members so that the check result of Step Se8 turns YES. Finally, the CPU 1 ends this ensemble process routine, thereby returning to the main routine (FIG. 6) through the key event process routine (FIG. 7).

Referring back again to FIG. 7, the check result of Step Sb1 is found NO when the detected key event is not the key-on event but the key-off event, thereby proceeding to Step Sb16. In this step, a key-off data KOFF is fed to all the tone generating channels which are assigned with the key codes KCs corresponding to the actuated keys. By such a manner, the generated tones corresponding to the turned-off keys are damped. As described above, in the key event process, the tone generation is conducted in response to the key event for the selected member of one class designated by the tone generation pointer TGR, while the control parameters involved in any class designated by the inheritance pointer INH_PTR are inherited and adopted in the tone generation.

Panel event process

Next, the description is given for the panel event process. In response to the panel event, Step Sa7 of-the main routine (FIG. 6) commences the panel event process routine shown in FIG. 11. The CPU 1 starts first Step Sf1 of this routine. Hereinafter, four cases of the typical panel operations will be described in conjunction with the FIG. 11 flowchart.

First case of descending edit command

Step Sf1 indicates YES when a descending edit command is inputted through the operation panel, which instructs an edit work of the timbre data hierarchy in descending order from an upper class to a lower class. In response to the descending edit command, Step Sf2 is undertaken to commence a descending process routine shown in FIG. 12. In the FIG. 12 routine, first Step Sg1 is undertaken to check as to if the edit pointer LEVEL designates the ensemble class ENS. If this check result is found YES (LEVEL="ENS"), subsequent Step Sg2 is undertaken to descend the edit pointer LEVEL from the ensemble class ENS to the part class PART which is to be edited. Then, Step Sg3 is undertaken to set the tone generation pointer TGR to the part class PART. Further, Step Sg4 is undertaken to set the inheritance pointer INH_PTR to the part class PART. Subsequently, Step Sg5 is undertaken to set the part address pointer PART_PTR by the part pointing information PPi (i=1–4) corresponding to a part member selected by the operator concurrently with the input of the descending edit command. Namely, a preceding ensemble item previously selected from the ensemble class involves a plurality of succeeding part members (e.g. four part members in this embodiment), hence the operator selects one of the four succeeding part members to be edited. Then, the routine proceeds to Step Sg11.

Figure 11:
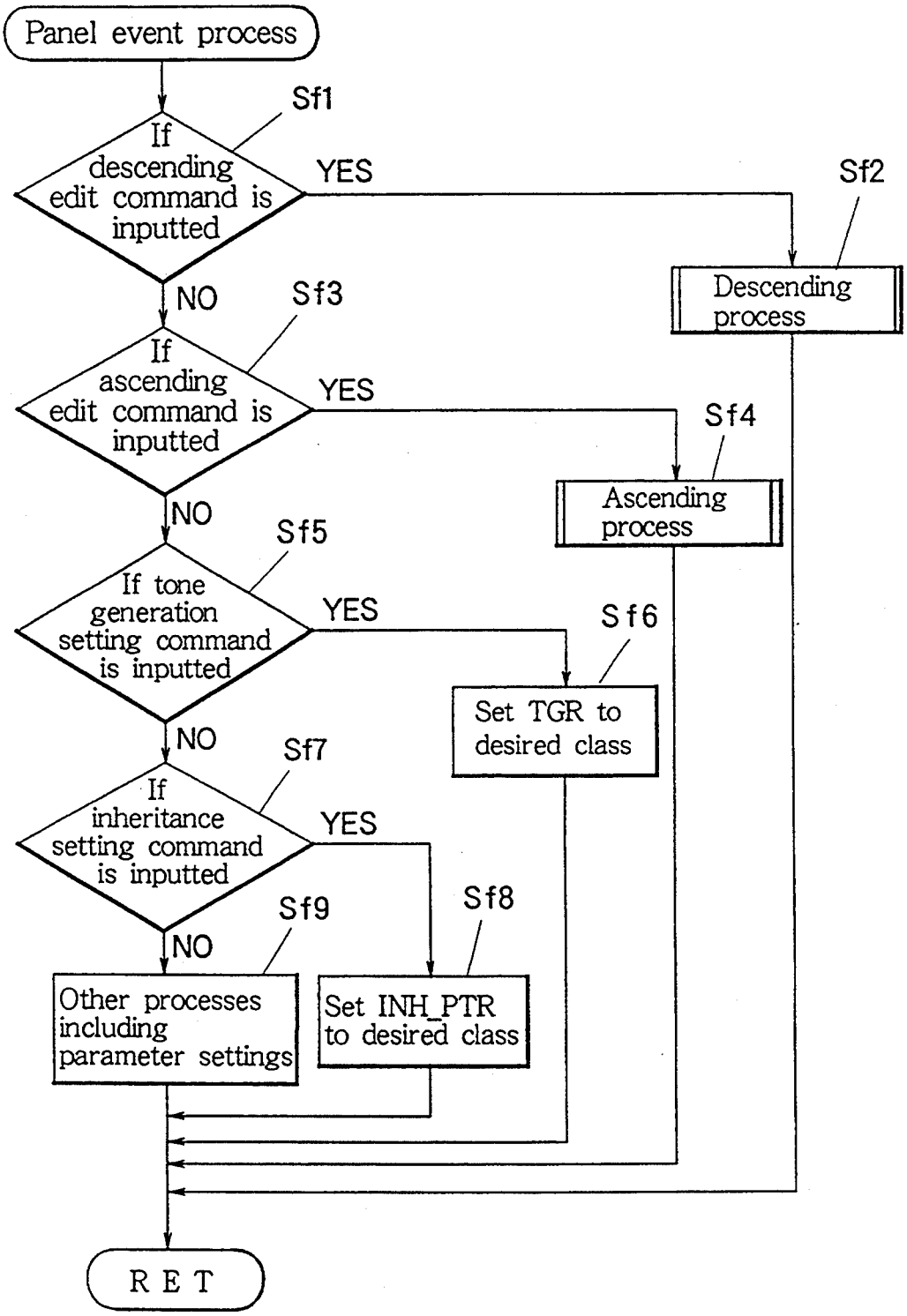
FIG. 11 is a flowchart showing a panel event process routine.
Figure 12:
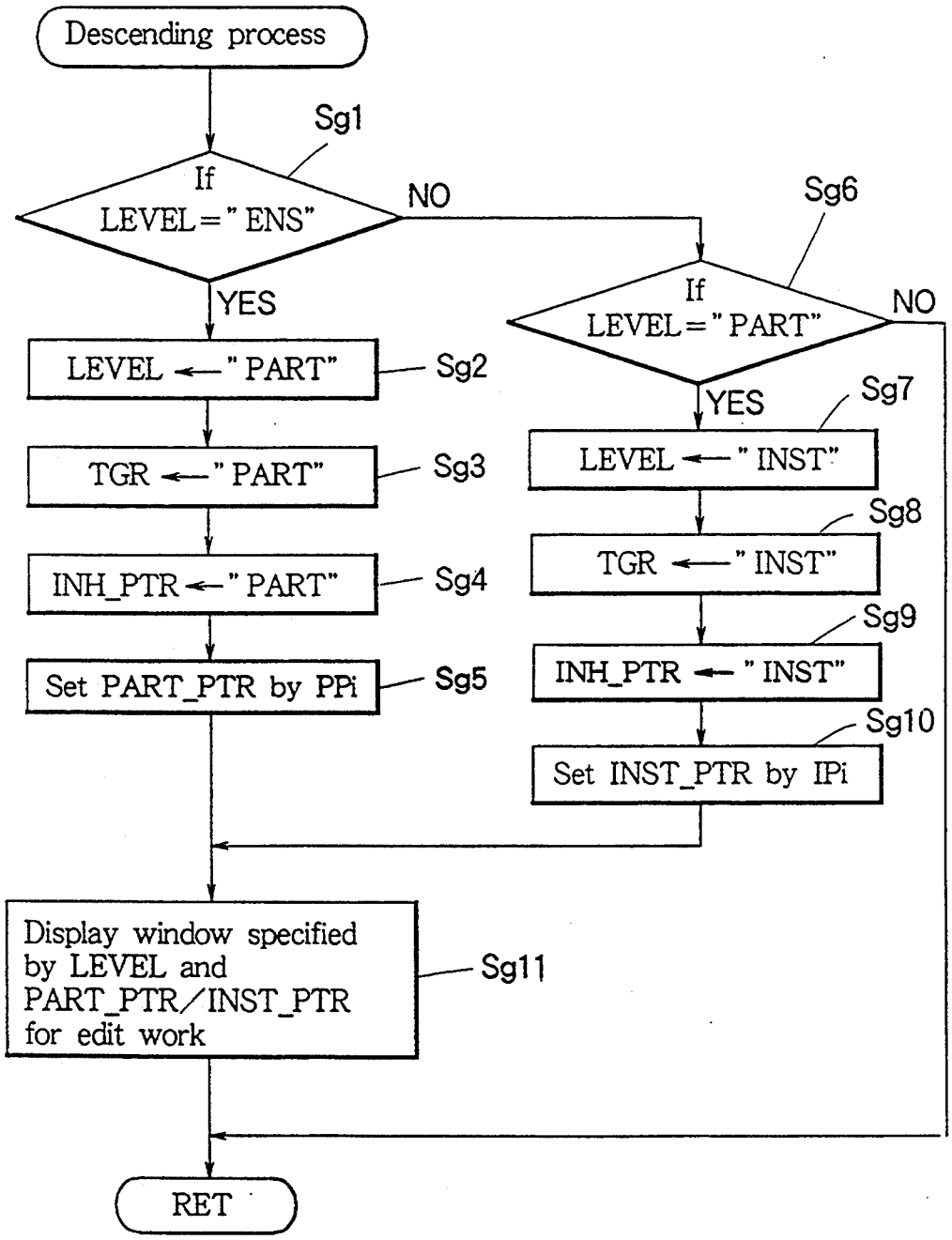
FIG. 12 is a flowchart showing a descending command process routine.

On the other hand, when the check result of Step Sg1 is found NO (i.e., LEVEL does not designate ENS), Step Sg6 is undertaken to check as to if the edit pointer LEVEL designates the part class PART. The check result of this step is found YES if LEVEL="PART", so that subsequent Step Sg7 is undertaken so as to descend the edit pointer LEVEL to the instrument class INST which is to be edited. Further, Step Sg8 is undertaken to set the tone generation pointer TGR to designate the instrument class INST. Moreover, Step Sg9 is undertaken to set the inheritance pointer INH_PTR to designate the instrument class INST. In next Step Sg10, the instrument address pointer INST_PTR is set with specified instrument pointing information IPi corresponding to an instrument member selected by the operator concurrently with the input of the descending edit command. Namely, a preceding part item previously selected from the part class involves a plurality of immediately succeeding instrument members (e.g., for instrument members in this embodiment), hence one of the four instrument members is selected for the edit work of parameters. Thereafter, the routine proceeds to Step Sg11. On the other hand, the check result of Step Sg6 is found NO when LEVEL does not designate PART but designates INST, hence the routine is instantly finished. Namely in this case, further descending operation is impossible because the instrument class INST is positioned in the lowest level of the timbre data hierarchy. Thus, the routine of FIG. 12 returns to the main routine of FIG. 6 through the panel event process routine (FIG. 11).

In the last Step Sg11, the display opens a desired window to show a class newly designated by the edit pointer LEVEL and a member newly selected by the pointer PART_PTR or INST_PTR in the descending operation. After the edit work is finished in Step Sg11, the routine of FIG. 12 returns to the main routine of FIG. 6 through the panel event process routine of FIG. 11. By such a manner, in response to the descending edit command, not only the edit pointer LEVEL descends to designate a succeeding class for the edit work, but also the tone generation pointer TGR and the inheritance pointer INH_PTR concurrently descend to designate the same class for the trial play and the data inheritance.

Second case of ascending edit command

Figure 13:
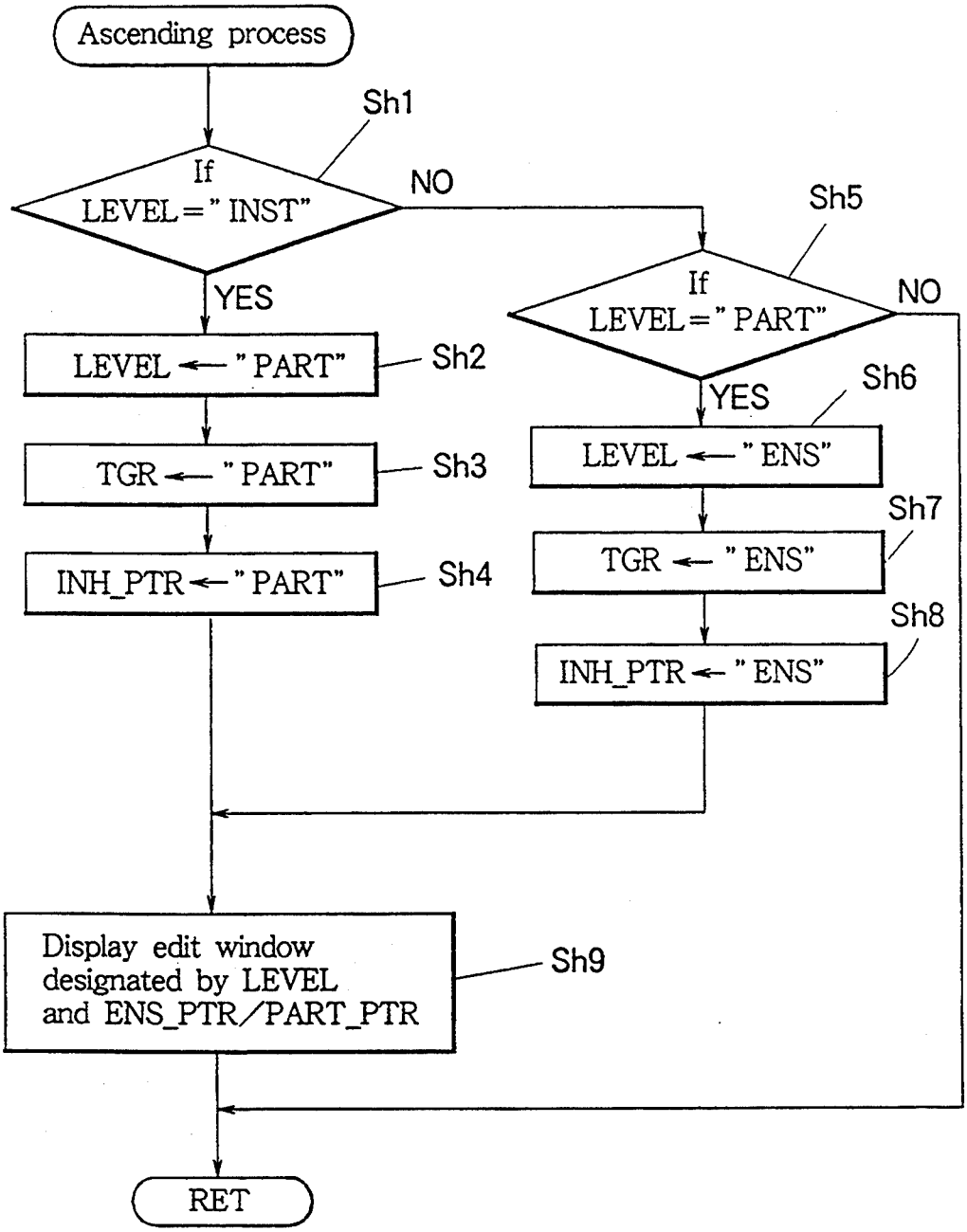
FIG. 13 is a flowchart showing an ascending command process routine.

Referring back to FIG. 11, the check result of Step Sf1 turns NO when the detected panel event indicates an ascending edit command, thereby proceeding to Step Sf3. In this step, check is made as to if the panel event indicates the ascending edit command which is effective to ascend a class to be edited. The check result of Step Sf3 is held YES in this case, thereby proceeding to Step Sf4 where an ascending process routine is commenced as shown in FIG. 13. The CPU 1 proceeds to first Step Sh1 of the FIG. 13 routine. In this step, check is made as to if the edit pointer LEVEL designates the instrument class INST. The check result is found YES when LEVEL designates INST, thereby proceeding to Step Sh2. In this step, the edit pointer LEVEL is ascended to designate the preceding part level PART to be edited. Then, Step Sh3 is undertaken to set the tone generation pointer TGR to designate the same part class PART. Further, Step Sh4 is undertaken to set the inheritance pointer INH_PTR to designate the part class PART. Thereafter, the routine proceeds to Step Sh9.

On the other hand, the check result of Step Sh1 is held NO when LEVEL does not designate INST, thereby proceeding to Step Sh5. In this step, check is made as to if the edit pointer LEVEL designates the part class PART. This check result is found YES when LEVEL designates PART, thereby proceeding to Step Sh6. In this step, the edit pointer LEVEL is ascended to designate the preceding ensemble class ENS for next edit work. Then, Step Sh7 is undertaken to set the tone generation pointer TGR to designate likewise the ensemble class ENS. Further, Step Sh8 is undertaken to set the inheritance pointer INH_PTR to designate likewise the ensemble class ENS, thereafter proceeding to Step Sh9. On the other hand, the check result of Step Sh5 is held NO when LEVEL does not designate PART but designates ENS, thereby instantly finishing this routine. Namely, in this case, the edit pointer LEVEL cannot ascend since the ensemble class ENS is positioned in the top level of the data hierarchy. Consequently, this routine of FIG. 13 returns to the main routine of FIG. 6 through the panel event process routine of FIG. 11.

Lastly in Step Sh9, the display opens a desired window to show a class newly designated by the edit pointer LEVEL and to show a member newly selected by the part pointer PART_PTR or the ensemble pointer ENS_PTR in the ascending operation. After the edit work is finished in Step Sh9, the routine of FIG. 13 returns to the main routine of FIG. 6 through the panel event process routine of FIG. 11. By such a manner similar to the descending operation, in response to the ascending edit command, not only the edit pointer LEVEL ascends to designate a preceding hierarchical class for the edit work, but also the tone generation pointer TGR and the inheritance pointer INH_PTR concurrently ascend to designate the same hierarchical class for the trial play and the data inheritance.

Third case of tone generation setting command

Referring back again to FIG. 11, when a tone generation setting command is inputted by the operation panel to designate a desired class for the tone generation, the check results of Steps Sf1 and Sf3 are held NO to thereby proceed to Step Sf5. In this step, check is made as to if the panel event indicates the tone generation setting command. In this case, the check result is found YES to thereby proceed to Step Sf6. In this step, the tone generation pointer TGR is set to designate a desired class specified by the operator. In contrast to the aforementioned descending and ascending operations, the tone generation setting operation can freely and independently designate a desired hierarchical class as an object of the trial play according to the command by the operator, while the edit pointer and the inheritance pointer are fixed. Then, this routine is finished to thereby return to the main routine.

Fourth case of inheritance setting command

When an inheritance setting command is inputted by the operation panel to designate a desired class from which the parameter originates for inheritance, the check results of Steps Sf1, Sf3 and Sf5 are all held NO to thereby proceed to Step Sf7. In this step, check is made as to if the panel event indicates the inheritance setting command. In this case, the check result is found YES to thereby proceed to Step Sf8. In this step, the inheritance pointer INH_PTR is set to designate a desired class by a request of the operator. In manner similar to the tone generation setting operation, the inheritance setting operation can freely and independently designate a desired class as an origin of the inheritance according to the request by the operator, while the edit pointer and the tone generation pointer are fixed. Then, this routine is finished to thereby return to the main routine.

When the panel event indicates other setting commands than the aforementioned ones, the check results of Steps Sf1, Sf3, Sf5 and Sf7 are all found NO to thereby proceed to Step Sf9. In this step, settings of various parameters or else are carried out according to an inputted command to effect edit process and other event processes. Then, this routine is finished to return to the main routine.

As described above, in the panel event process, the respective pointers can be set according to those of descending edit command, ascending edit command, tone generation setting command and inheritance setting command by the operator as well as the various event processes are carried out according to other commands. As mentioned above, in this embodiment, the musical tone is generated based on the timbre data hierarchy composed of, for example, the lower instrument class, the middle part class and the higher ensemble class. Those of edit pointer LEVEL, tone generation pointer TGR and inheritance pointer INH_PTR are managed independently and separately from each other to designate respective desired classes. By such a manner, a desired class is designated by TGR so that the musical tone can be generated according to timbre data and parameters belonging to those of the designated class and its succeeding classes, without regard to the class in which the edit work is conducted. Further, a desired preceding class is designated by INH_PTR such that the musical tone can be generated according to the parameters inherited from the designated preceding class in addition to the timbre data belonging to a succeeding class which may be designated by TGR after the edit work is applied thereto.

Modifications

Figure 14:
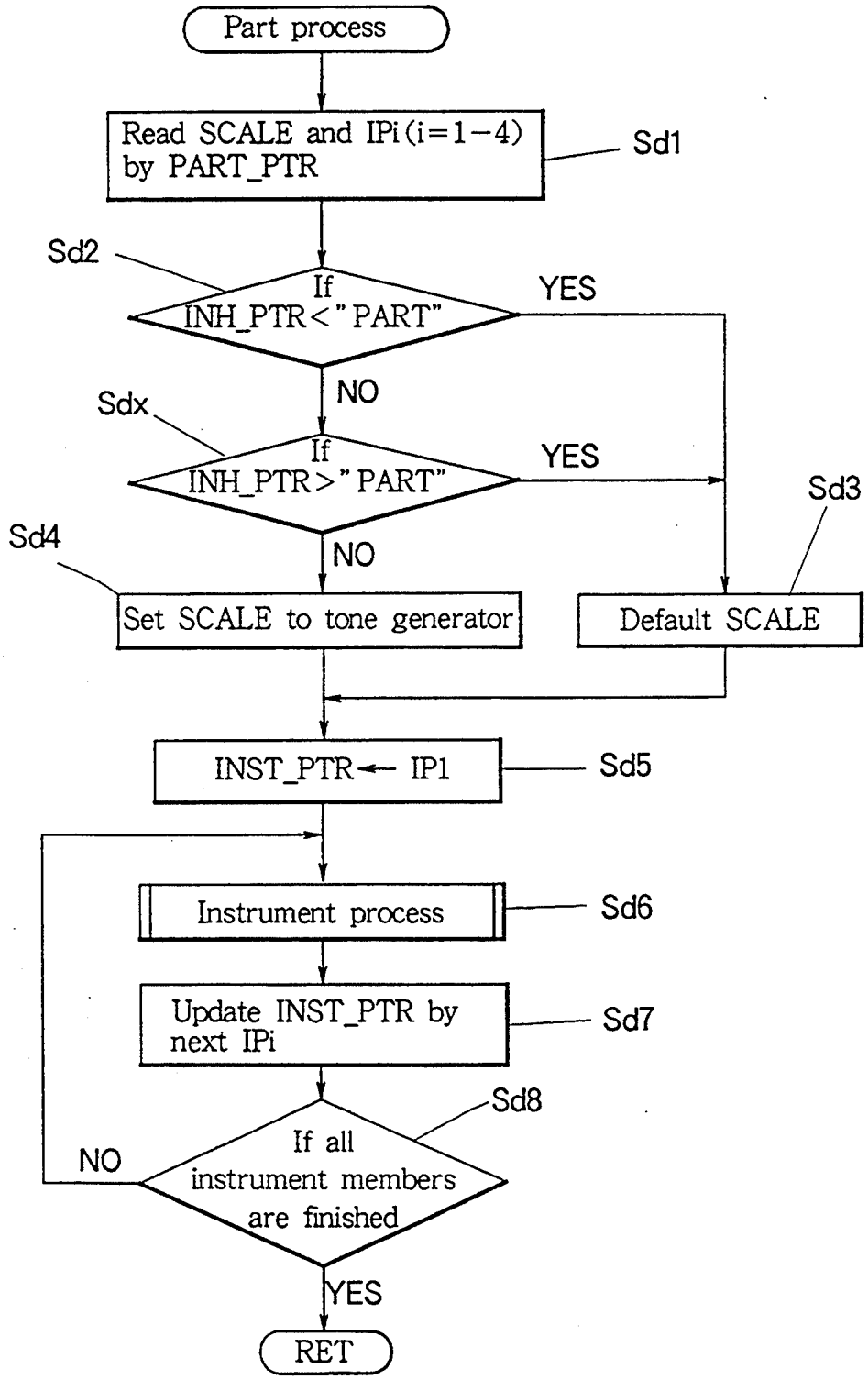
FIG. 14 is a flowchart showing a modification of the part process routine shown in FIG. 9.

FIG. 14 shows one modification of the part process routine shown in FIG. 9. The basic steps are identical to those of the FIG. 9 part process, hence the corresponding steps are labeled by the same references. The difference is that step Sdx is undertaken when the check result of Step Sd2 is held NO. Check is made in Step Sdx as to if the inheritance pointer INH_PTR is positioned higher than the part class PART (INH_PTR>'-'PART"). This check result is found NO when INH_PTR designates PART (INH_PTR="PART"), thereby proceeding to Step Sd4 where the level key scaling parameter SCALE is set to the tone generator. On the other hand, the check result of Step Sdx is found YES when INH_PTR designates ENS (INH_PTR='-'ENS"), thereby proceeding to Step Sd3 where the level key scaling parameter SCALE is made default. In contrast to the part process of FIG. 9, when the inheritance pointer designates the ensemble class ENS, the intervening parameter SCALE belonging to the part class PART is not inherited to the instrument class for the tone generation.

In the above described embodiments, each part item is composed of four instrument members, and each ensemble item is composed of four part members. Alternatively, one item in a preceding class may be composed of two or eight members of a succeeding class. Further, the timbre data hierarchy (musical tone control data hierarchy) is composed of three levels of the instrument, part and ensemble classes in this embodiment. Generally, the data hierarchy may be composed of a desired number of classes. The electronic musical instrument adopts the tone generator of the waveform memory addressing type in this embodiment; however, other kinds of tone generators can be selected such as a frequency modulation type.

As described above, according to the invention, the musical tone can be generated from a desired class during the course of editing the musical tone control data hierarchy. Further, the musical tone can be generated according to parameters inherited from an upper class than a designated class subjected to the edit work. By such a manner, the operator can conduct a trial play to efficiently evaluate the edit results to thereby facilitate composition of desired music sounds.

What is claimed is:

1. An electronic musical instrument constructed to carry out an edit work of control parameters and a trial play to evaluate the edit work in response to a trial command, comprising:

memory means for memorizing the control parameters in a hierarchical structure to define a plurality of hierarchical classes of the control parameters;

first designating means for designating a first hierarchical class as an object of the edit work;

edit means for changing a control parameter belonging to the first hierarchical class to carry out the edit work;

second designating means operable independently from the first designating means for designating a second hierarchical class as an object of the trial play freely from the edit work; and tone generator means responsive to a trial command for generating a musical tone based on a control parameter belonging to the second hierarchical class to thereby carry out the trial play.

2. An electronic musical instrument according to claim 1; including third designating means operable separately from the first and second designating means for designating a third hierarchical class which precedes the second hierarchical class such that a control parameter belonging to the third hierarchical class is inherited to the second hierarchical class for use in the trial play.

3. An electronic musical instrument according to claim 2; wherein the third designating means further comprises means for inheriting another control parameter belonging to an intervening hierarchical class between the third and second hierarchical classes, concurrently with the control parameter belonging to the third hierarchical class.

4. An electronic musical instrument according to claim 1; wherein the second designating means further comprises means for designating the second hierarchical class higher than the first hierarchical class.

5. An electronic musical instrument according to claim 1; wherein the second designating means further comprises means for designating the second hierarchical class lower than the first hierarchical class.

6. An electronic musical instrument according to claim 1; wherein the second designating means further comprises means for designating the second hierarchical class identical to the first hierarchical class.

7. An electronic musical instrument constructed to carry out an edit work of control parameters and a trial play to evaluate the edit work in response to a trial command, comprising:

memory means for memorizing the control parameters in a hierarchical structure to define a plurality of hierarchical classes of the control parameters;

edit means for selectively changing a desired control parameter to carry out the edit work in the hierarchical structure;

a designating means for designating one hierarchical class as an object of the trial play after the edit work;

tone generator means responsive to a trial command for generating a musical tone based on a control parameter belonging to said one hierarchical class to carry out the trial play; and another designating means for designating another hierarchical class which precedes said one hierarchical class such that another control parameter belonging to said another hierarchical class is selectively inherited to said one hierarchical class for use in the trial play.

8. An electronic musical instrument according to claim 7; including an additional designating means for designating a desired hierarchical class from which a desired control parameter is selected by the edit means for the edit work.

9. An electronic musical instrument according to claim 7; wherein said another designating means further comprises means for inheriting an intervening control parameter belonging to an intervening hierarchical class between said another hierarchical class and said one hierarchical class, concurrently with the control parameter belonging to said another hierarchical class.

10. An electronic musical instrument constructed to carry out an edit work of control parameters and a trial play to evaluate the edit work in response to a trial command, comprising:

memory means for memorizing the control parameters in a hierarchical structure to define a plurality of hierarchical classes of the control parameters;

a designating means for designating one hierarchical class as an object of the edit work;

edit means for changing a control parameter belonging to said one hierarchical class to carry out the edit work;

tone generator means responsive to a trial command for generating a musical tone after the edit work based on a control parameter belonging to a, desired hierarchical class to thereby carry out the trial play; and another designating means for designating another hierarchical class which precedes the desired hierarchical class such that another control parameter belonging to said another hierarchical class is inherited to the desired hierarchical class for use in the trial play.

* * * * *